US006799816B2

(12) United States Patent
Touzani

(10) Patent No.: US 6,799,816 B2
(45) Date of Patent: Oct. 5, 2004

(54) ERGONOMIC BI-LEVEL WORKSTATION

(76) Inventor: William N. Touzani, 7655 Moonmist, #123, Houston, TX (US) 77036

( * ) Notice: Subject to any disclaimer, the term of this patent is extended or adjusted under 35 U.S.C. 154(b) by 39 days.

(21) Appl. No.: 10/290,929

(22) Filed: Nov. 12, 2002

(65) Prior Publication Data

US 2004/0090153 A1 May 13, 2004

(51) Int. Cl.[7] ..... A47B 81/00

(52) U.S. Cl. ..... 312/208.1; 312/223.3; 108/93; 248/918

(58) Field of Search ..... 312/223.3, 208.1; 108/50.02, 143, 92, 93; 248/346.01, 298.1, 918, 118

(56) References Cited

U.S. PATENT DOCUMENTS 4,709,972 A * 12/1987 LaBudde et al. ..... 312/208.3
5,287,815 A * 2/1994 Gross ..... 108/50.14
5,623,881 A * 4/1997 Huang ..... 108/50.01
6,070,838 A * 6/2000 Luginsland ..... 248/118.5
6,099,093 A * 8/2000 Spence ..... 312/196
6,474,760 B2 * 11/2002 Rauls ..... 312/330.1
6,702,410 B2 * 3/2004 Kusztal et al. ..... 312/302

* cited by examiner

*Primary Examiner*—Laurie K. Cranmer

(57) ABSTRACT

In one embodiment, a computer desk 8 comprises a stationary desktop 12 for supporting a computer screen, a tray 18 having an upper keyboard supporting surface spaced below the desktop surface, a wrist support 20 secured to a forward end of the tray, and a forearm support 40 slidably moveable in front of or behind the keyboard. In another embodiment, the desk is used with an articulating workstation assembly comprising an articulating arm 40 attached to the desk and a workstation assembly supported on a free end of the articulating arm. The workstation assembly includes a lower shelf 53 attached to an articulating arm, and an upper shelf 54 slidably moveable with a wrist support 58 relative to the lower shelf.

13 Claims, 2 Drawing Sheets

ERGONOMIC BI-LEVEL WORKSTATION

FIELD OF THE INVENTION

This invention relates to an ergonomic workstation and, more particularly, to a workstation desk adapted for use with a moveable computer keyboard.

BACKGROUND OF THE INVENTION

With the popularity of the Internet, the computer has become a friendly companion to people of all ages who spend hours on the computer working, learning, or browsing. Computer work is, however, also taking a toll on millions of clerical workers, causing tension in the neck and shoulders, problems with wrists, and poor blood circulation. An ergonomic workstation environment can reduce injuries, increase worker comfort, limit fatigue, and increase productivity.

Various accessories have been introduced to provide wrist and forearm support to a computer user, varying from wide and thick rubber pads or cushions to forearm support devices that can be attached to the workstation surfaces. A significant problem with such pads, moreover, is that the large space they occupy practically eliminates the writing or planar working surface that otherwise would be available to the user. Attachable forearm support arms, on the other hand, are expensive, and are not practical for many individuals.

U.S. Pat. No. 5,833,180 discloses a forearm and wrist support with a computer mouse operating pad and a clamp for attaching the assembly to a desk. U.S. Pat. No. 5,876,002 discloses an arm and mouse support which may be mounted to the desktop or to a desk drawer. U.S. Pat. No. 6,264,150 discloses an armchair with a forearm support. U.S. Pat. No. 6,402,100 discloses a lower arm suspension which enables the device to follow the limited working movement of the hand, and may be either stationary during use or may move about the work surface. U.S. Pat. No. 5,772,292 discloses a computer desk with a moveable lower shelf positioned below an upper shelf for receiving another part of the computer. The lower shelf may move outwardly from the desk such that a portion of the lower shelf extends the total desk top surface. While the elevated frontal section may provide forearm support, the keyboard cannot practically be moved closer to the user while still providing wrist support.

The disadvantages of the prior art are overcome by the present invention, and an improved ergonomic workstation is hereinafter disclosed. The concepts of the present invention may be used to manufacture a desk or other workstation with the improvements, but also may be added to an existing desk or workstation.

SUMMARY OF THE INVENTION

In one embodiment, a two part desktop surface comprises a fixed forward wrist support and a moveable forearm support. The forearm support may be in the shape of a slidable plate or tray, which may be slid forward for positioning against the wrist support with the keyboard rearward of the forearm support, and may alternatively be slid rearward so that the keyboard is positioned between the wrist support and the forearm support. Some users, such as children, may be unable to reach deep into the desk and may choose to place the keyboard against the wrist support. To provide forearm support, however, the forearm support may be moved forward against the wrist support, and the keyboard placed behind the forearm support. In this latter position, the forearm support also provides an additional writing surface or work surface when needed. Consequently, high flexibility to switch between a nested keyboard in the front or behind the wrist support is provided to satisfy individual preferences. The forearm support may be mounted on slides or rails. A computer monitor conventionally may be provided on a top surface of the desk or workstation.

In another embodiment, an articulating workstation assembly is provided for mounting to a desk. The moveable workstation assembly has a lower shelf for storing the keyboard when in one position, and an upper forward shelf for the forearm support or for writing. The upper and lower shelves may overlap for easy storage of the workstation assembly under the desktop. The folded feature of the shelves also allows the assembly to be used in a conventional manner, with a keyboard on the upper shelf and resting against a wrist support. The moveable shelf assembly may also be positioned so that the keyboard is supported on the lower rearward shelf, with the upper forward shelf providing a forearm support. The upper shelf may include a sheet formed from a transparent material, such as glass or plastic, which may be used to cover printed material, such as instructions or family pictures, on the lower plate.

It is an object of the present invention to provide a computer desk with a tray having a keyboard supporting surface spaced below a desktop surface, a wrist support secured to a forward end of the tray and having an upper wrist support surface spaced above the keyboard supporting surface, and a forearm support slidably moveable above the keyboard supporting surface, such that the forearm support is rearward of the keyboard when the keyboard is in the forward position, and the forearm support is between the wrist support and the keyboard when the keyboard is in the rearward position.

It is another object of the invention to provide an articulating workstation assembly including an articulating arm attached to the desk and a workstation assembly supported on the free end of the articulating arm. The workstation assembly includes a lower shelf secured to the free end of the articulating arm, and an upper shelf slidably moveable relative to the lower shelf. A wrist support is positioned on a forward end of the upper shelf.

It is a feature of the present invention that the tray and the upper keyboard surface supporting thereon may be slidably moveable relative to the desktop, but in an alternate embodiment may be fixed relative to the desktop.

It is a further feature of the invention that guide members may be provided on the right side and the left side of the forearm support for guiding the sliding movement of the forearm support with respect to the tray. A tongue and groove arrangement may thus be provided for sliding the forearm support relative to this tray, and optionally for sliding the tray relative to the desk.

A further feature of the invention is that the upper surface of the forearm support may be substantially parallel with an upper surface of the wrist support, thereby providing a relatively large writing or work surface when the forearm support is between the wrist support and the keyboard.

For the embodiment which includes an articulating arm, the workstation assembly preferably includes a left side guide plate and a right side guide plate for guiding movement of the upper shelf with respect to the lower shelf. The tongue and groove arrangement may be provided for accomplishing this sliding movement.

It is a further feature of the invention that the upper shelf is sized to receive the keyboard when the upper shelf is positioned substantially directly above the lower shelf, and the lower shelf is sized to receive the keyboard when the upper shelf is slid forward with respect to the lower shelf, so that the upper surface of the upper shelf provides a forearm support.

A significant feature of the invention that a sheet may be placed on the upper shelf, such as the upper shelf and the sheet provide the desired forearm support when the keyboard is positioned on the lower shelf. The sheet may be transparent, such that written material may be positioned on the upper shelf and below the transparent sheet. The upper surface of the sheet and the upper surface of the wrist support may be substantially parallel, thereby providing a desired work surface.

A significant advantage of the invention is that a particular computer user is provided with increased flexibility to use the computer in a manner most comfortable for a particular computer task. A related advantage of the invention is that the slidable forearm support provides increased user comfort and reduced user stress.

Another advantage of this invention is that the cost of the invention is relatively nominal compared to the cost of a desk or other workstation, although the flexibility of utilizing the desk or workstation with a computer is greatly enhanced. A related advantage of the invention is that the forearm support may be used in conjunction with a transparent sheet so that the user may see through the sheet to the writing below the sheet.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
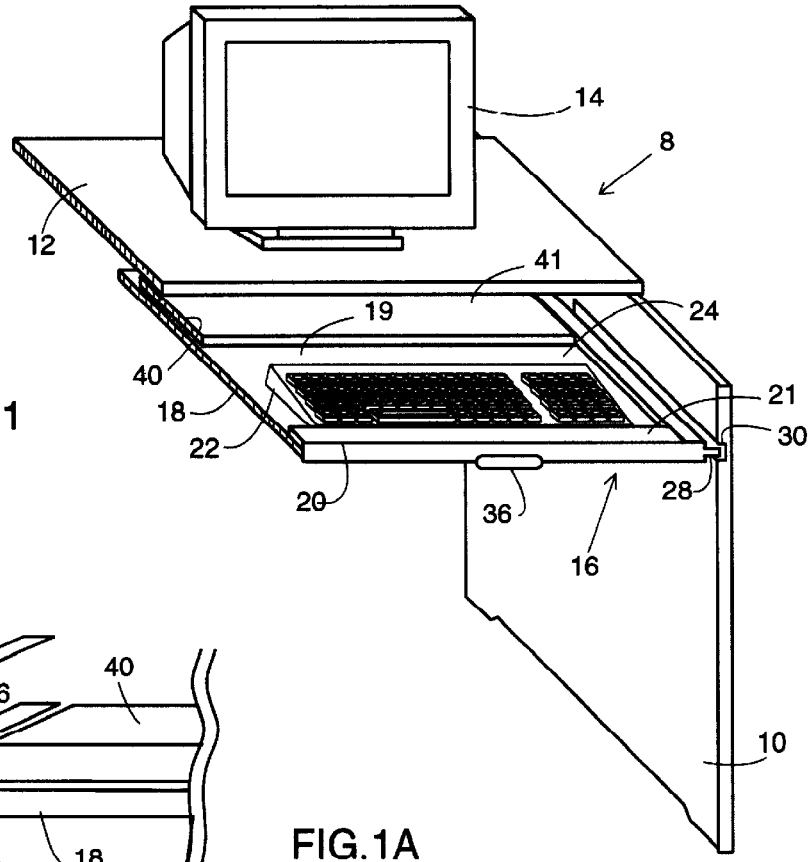
FIG. 1 is a perspective cutaway view of a portion of a computer desk with sliding forearm support pushed back and the keyboard placed directly behind a wrist support.

FIG. 1 discloses a right side support panel 10 of a conventional workstation or desk 8 with a stationary shelf or desktop 12 for supporting a computer monitor 14. The left side and rear desk support panel are omitted in FIG. 1 for clarity. A keyboard platform assembly 16 comprising a tray 18 is slidable with respect to the desk between a front position as shown in FIG. 1 and a rearward position wherein most or all of the assembly 16 is directly beneath the stationary shelf 12. The keyboard platform assembly includes a wrist support 20 which has an upper substantially planar surface 21 raised with respect to the upper surface 19 of the tray 18, and a forearm support 40, which preferably is in the form of a substantially rectangular plate, with a substantially planar upper surface 41. The forearm support 40 is also slidable with respect to the tray 18.

When the forearm support 40 is positioned behind the keyboard 22, as shown in FIG. 1, the keyboard 22 rests directly on the upper surface 19 of the tray 18, so that the wrist support 20 is elevated with respect to the keyboard to provide the desired support for the wrist. The components of the keyboard platform assembly 16 are thus configured to provide an opening 24 between the rearward forearm support 40 and the forward wrist support 20 sized for receiving a conventional keyboard 22 on the planar upper surface 19 of the slidable tray 18. In a position as shown in FIG. 1, the keyboard may be easily accessed by children or other individuals who desire only a wrist support and not a forearm supports.

Figure 2:
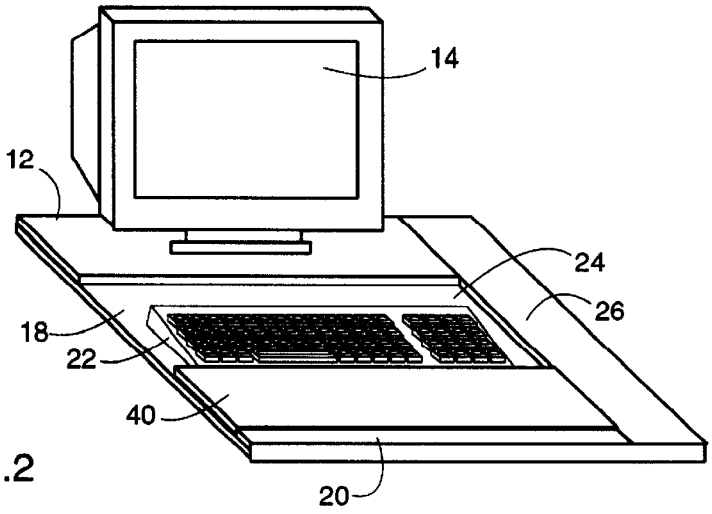
FIG. 2 is a perspective view of an alternate desk with the sliding forearm support moved forward of the keyboard.

FIG. 2 shows the forearm support 40 slid against the wrist support 20 so that the opening 24 for receiving the keyboard 22 is now behind both the wrist support 20 and the forearm support 40. FIG. 2 also illustrates that the upper surface of the forearm support may be substantially planar with the upper surface of the wrist support, thereby providing a substantially uniform height wrist and forearm support for use with the recessed keyboard, while also providing a relatively large writing or workstation desktop surface in front of the keyboard formed by the combined wrist and forearm supports.

FIG. 2 also illustrates an embodiment wherein the tray 18 is not slidable with respect to the desk, as shown in FIG. 1, but rather is stationary with respect to the desktop 12. Left side and right side panels 26 which are also stationary with the desk enable the forearm support 22 to easily slide to its forward position as shown in FIG. 2 to its rearward position as shown in FIG. 1. FIG. 2 also illustrates that the keyboard platform assembly 16 may be constructed with the desk and the revised desktop. This desk may be used, for example, as a cubicle desktop, with the monitor 14 being placed on either the desktop 12 or on the fixed tray 18.

Figure 1A:
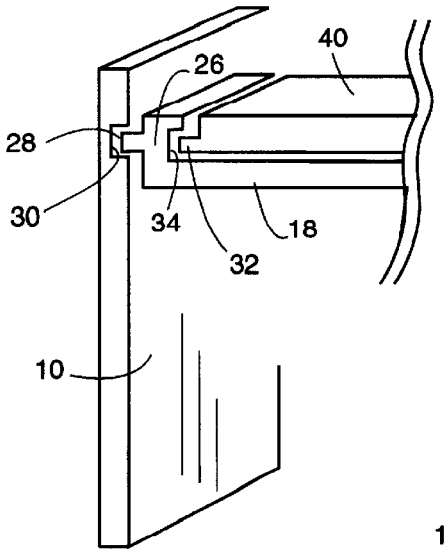
FIG. 1A is a detailed view illustrating a conventional tongue and slot arrangement for allowing movement of the forearm support with respect to the desktop plate, and also allowing sliding movement of the desktop plate with respect to the stationary desk.

FIG. 1A illustrates a tongue and groove assembly for sliding the tray 18 relative to the desk. On both the right side and the left side of the tray 18, an angled support 26 with a protruding tongue 28 is positioned within the groove 30 in the desk to allow the tray 18 to easily slide with respect to the desk. In a similar manner, the forearm support 40 may include a left side and a right side tongue 32 which fits within the groove 34 in the support 26 of the tray 18 to allow the forearm support to slide with respect to the tray 18. Other conventional mechanisms may be used for sliding the forearm support with respect to the tray 18 and, in the FIG. 1 option, the tray with respect to the desk. In an alternate embodiment, a tongue could be provided on the desk and the groove provided in the tray 18, and similarly the tongue could be provided on the tray 18 and the groove provided in the forearm support. The guiding mechanism which allows for sliding movements of these components preferably is provided on both the right side and the left side of the slidable component, although in other embodiments, guide tracks, friction reducing rollers, and friction reducing pads could be provided on the lower side of the forearm support 40 and/or on the upper surface of the tray 18. Guide tracks of the type used for sliding desk drawers in and out with respect to the desk, rails, guides, and, if desired, rollers or other members to reduce friction between the moving component and the stationary component may be provided. If the tray 18 is slidable with respect to the desk, as shown in FIG.

1, a conventional handle 36 may be attached to the front of the platform assembly 16 to facilitate movement of a platform assembly with respect to the desk.

Figure 3:
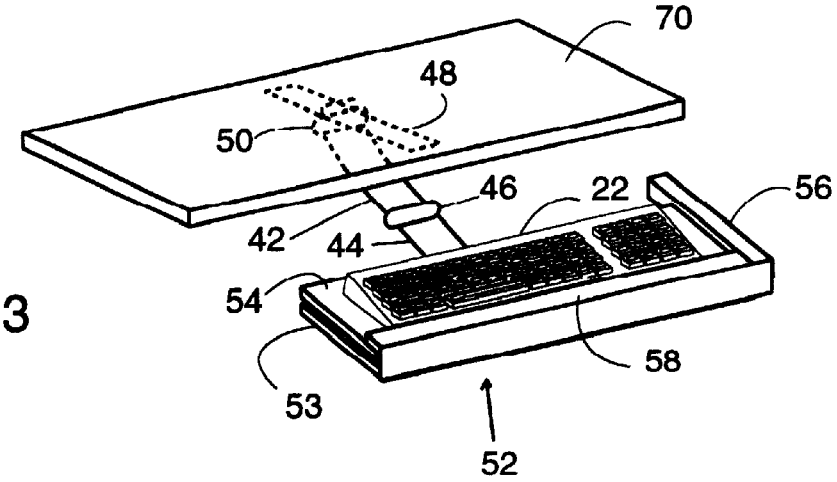
FIG. 3 is a perspective view of an articulating arm and keyboard platform comprising overlapping boards.
Figure 4:
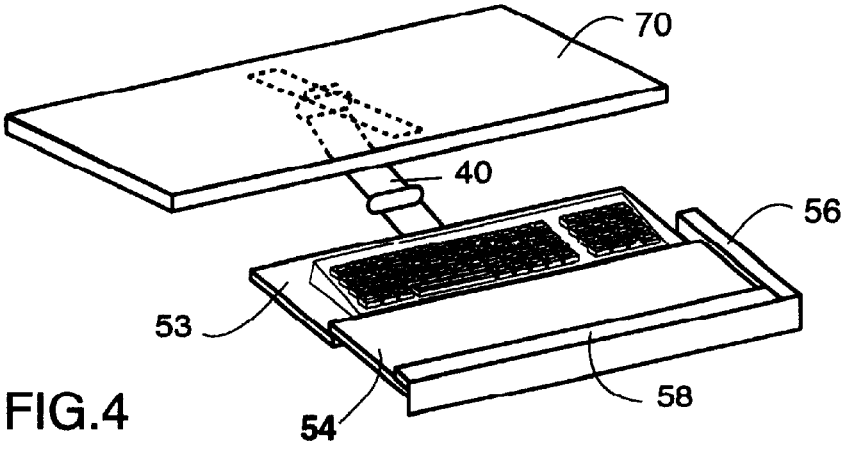
FIG. 4 is a perspective view of the articulating arm and keyboard as shown in FIG. 3, with the keyboard placed on the lower board.
Figure 5:
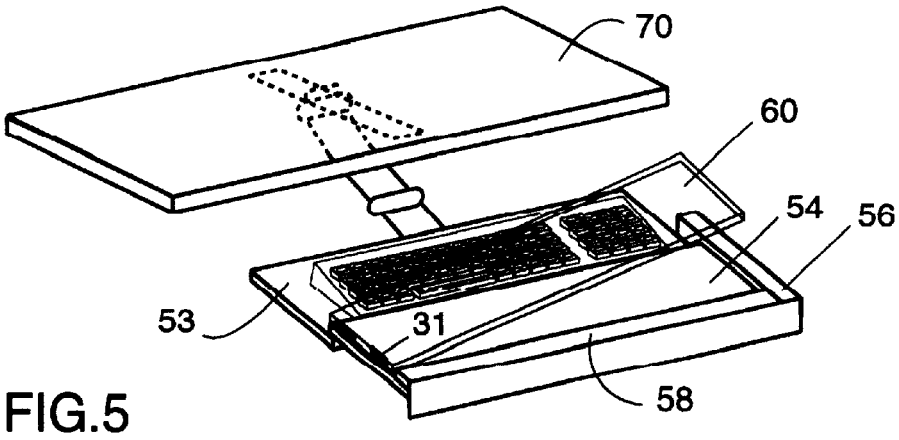
FIG. 5 is a perspective view of the articulating arm and keyboard platform shown in FIG. 4, with a transparent cover for positioning on the upper board.

FIGS. 3–5 illustrate another embodiment of the present invention, wherein an articulating arm workstation assembly 40, conventionally made from a metallic or plastic material, includes arm segments 42 and 44 interconnected by a joint 46. The arm assembly 40 may be attached to a rail member 48 by elbow joint 50, with the rail member 48 in turn being secured with screws, bolts or other securing members to the underside of support surface 70 of the desk 8. The joints 46, 50 allow the raising or lowering of the keyboard platform assembly 52 with respect to the desk, with the lower end of the arm assembly 40 attached to the underside of the lower shelf 53. As shown in FIG. 3, an upper shelf 54 preferably having substantially the same upper and lower surface dimensions as the lower shelf 53 sized for receiving the keyboard 22, with the keyboard optionally being positioned against either the left side or right side guide plate 56 and against the wrist support 58, which as shown has an upper surface 59 elevated with respect to the upper surface of upper shelf 54, such that the keyboard is recessed with respect to the wrist support. The left side and a right side guide plates 56 may also include grooves for sliding the upper plate 54 forward along with the wrist support 58 with respect to the lower plate 53, which as explained above is held in position by the arm assembly 40. Again, a tongue and groove or other rail or guide members may be used for this purpose, as discussed above.

FIG. 3 thus shows the overlapping upper and lower shelves 54, 53 in the folded position so that the keyboard 22 rests on the upper shelf and is recessed with respect to the wrist support 58. When the upper shelf and wrist support are moved to position as shown in FIG. 4, the keyboard may then be positioned on the lower shelf 52, so that the upper shelf 54 acts as a forearm support to cooperate with the wrist support 58 to provide additional support to the user. In the extended position as shown in FIG. 4, the upper shelf 54 may also act as a tray for receiving a mouse.

FIG. 5 illustrates a preferred design wherein, when the upper shelf 54 is moved forward as shown in FIG. 4, a transparent sheet material 60, such as Plexiglas, may be positioned on the upper shelf so that the top surface of the sheet 60 is substantially at the same level as the top surface of the wrist support 58. This feature allows instructions, codes, pictures, or other printed material to be placed underneath the sheet 60 for easy viewing by the user, while simultaneously providing both a wrist support and a forearm support which are at substantially the same level with respect to the recessed keyboard. Pictures are commonplace in an office environment, but positioning them relative to the workstation can be a problem. The embodiment as shown in FIG. 5 provides an easy and effective technique to display pictures, instructions, or other documents during work hours, while hiding them from view after hours by folding the articulating assembly as shown in FIGS. 3–5 under the desktop. The transparent sheet 60 may also be made from clear plastic or glass, and may be removed to place pictures or other documents under the glass then reinstalled on the top of the upper shelf, while simultaneously providing forearm support and, in cooperation with the wrist support, providing a substantially planar writing and/or work surface. In another embodiment, the sheet 60 may be eliminated, in which case the upper shelf provides forearm support, but does not provide the same extent of forearm support as in the FIG. 5 embodiment, and also does not provide the writing surface of the FIG. 5 embodiment, since the upper surface of the upper shelf 54 is desirable lower than the upper surface of the wrist support 58 for use when the workstation is as shown in the FIG. 3 configuration.

It will be understood by those skilled in the art that the embodiment shown and described are exemplary and various other modifications may be made in the practice of the invention. Accordingly, the scope of the invention should be understood to include such modifications which are within the spirit of the invention.

What is claimed is:

1. A computer desk, comprising:

a stationary desktop with an upper desktop surface for supporting a computer screen;

a tray having an upper keyboard supporting surface spaced below the desktop surface for supporting a keyboard in one of a forward position and a rearward position;

a wrist support secured to a forward end of the tray and having an upper wrist support surface spaced above the keyboard supporting surface; and a forearm support slidably moveable above the keyboard supporting surface, such that the forearm support is rearward of the keyboard when the keyboard is in the forward position, and the forearm support is between the wrist support and the keyboard when the keyboard is in the rearward position.

2. A computer desk as defined in claim 1, further comprising:

the tray and the upper keyboard supporting surface are fixed relative to the desktop.

3. A computer desk as defined in claim 1, wherein the tray is slidably moveable with respect to the desktop between a forward use position and rearward storage position.

4. A computer desk as defined in claim 3, further comprising:

guide members on the right side and the left side of the tray for guiding sliding movement of the tray with respect to the desktop.

5. A computer desk as defined in claim 4, wherein the guide members include an extending tongue on one of the tray and the desk, and a receiving groove on the other of the tray and the desk, such that the tongue slides within the groove during movement of the tray.

6. A computer desk as defined in claim 1, further comprising:

guide members on the right side and the left side of the forearm support for guiding sliding movement of the forearm support with respect to the tray.

7. A computer desk as defined in claim 6, wherein the forearm support includes one of a protruding tongue and a receiving groove, and the tray includes the other of the protruding tongue and the receiving groove, such that the tongue slides within the groove during movement of the forearm support with respect to the tray.

8. A computer desk as defined in claim 3, further comprising:

a handle for moving the tray between the forward use position and the rearward storage position.

9. A computer desk as defined in claim 1, wherein the keyboard supporting surface is substantially parallel with the desktop surface.

10. A computer desk as defined in claim 1, wherein the upper surface of the forearm support is substantially parallel with an upper surface of the wrist support.

11. A keyboard platform assembly for use with a computer desk having a stationary desktop with an upper desktop surface, the computer screen being supported on one of the desk and the keyboard platform assembly, the keyboard platform assembly comprising:

a tray having an upper keyboard supporting surface spaced below the desktop surface for supporting a keyboard in one of a forward position and a rearward position;

a wrist support secured to a forward end of the tray and having an upper wrist support surface spaced above the keyboard supporting surface; and a forearm support slidably moveable above the keyboard supporting surface, such that the forearm support is rearward of the keyboard when the keyboard is in the forward position, and the forearm support is between the wrist support and the keyboard when the keyboard is in the rearward position.

12. A keyboard platform assembly as defined in claim 11, wherein the tray is slidably moveable with respect to the desktop between a forward use position and rearward storage position.

13. A keyboard platform assembly as defined in claim 11, further comprising:

guide members on the right side and the left side of the forearm support for guiding sliding movement of the forearm support with respect to the tray.

* * * * *